US005947229A

United States Patent [19]

Hede et al.

[11] Patent Number: 5,947,229

[45] **Date of Patent: *Sep. 7, 1999**

[54] ENERGY ABSORBING DEVICE FOR USE WITH A SAFETY LANYARD AND SYSTEM INCLUDING THE DEVICE

[75] Inventors: Jean Marc Hede, La Tronche; Paul Petzl, Barraux, both of France

[73] Assignee: Zedel, Crolles, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/620,004

[22] Filed: Mar. 21, 1996

[30] Foreign Application Priority Data

Mar. 27, 1995 [FR] France ..... 95 03778

[51] Int. Cl.[6] ..... A62B 35/00

[52] U.S. Cl. ..... 182/5; 182/191; 188/65.4

[58] Field of Search ..... 182/5, 6, 191–193; 188/65.4

[56] References Cited

U.S. PATENT DOCUMENTS

| | | | |
|---|---|---|---|
| 316,870 | 4/1885 | Braunfeld | 188/65.4 |
| 890,898 | 6/1908 | Gaillae | 182/191 |
| 4,667,772 | 5/1987 | Kammerer . | |
| 4,774,742 | 10/1988 | Johnson . | |

FOREIGN PATENT DOCUMENTS

| | | | |
|---|---|---|---|
| 107321 | 3/1875 | France | 188/65.4 |
| 2694044 | 1/1994 | France . | |
| 2701402 | 8/1994 | France . | |
| 2706314 | 12/1994 | France . | |
| 678152 | 8/1991 | Switzerland . | |
| 691736 | 5/1953 | United Kingdom . | |
| 16439 | 9/1992 | United Kingdom | 182/191 |

*Primary Examiner*—Alvin Chin-Shue
*Attorney, Agent, or Firm*—Oliff & Berridge, PLC

[57] ABSTRACT

An energy absorbing device for a safety device with a rope, comprises a metal body equipped with a first orifice of ellipsoidal shape allowing two strands of rope to cross without clearance, and a second reverse V-shaped orifice of decreasing cross-section in the direction of the first orifice. The second orifice has a portion of reduced width of a smaller dimension than the diameter of the rope, and two convergent edges for centering the rope when the turn is tightened during sliding. The lanyard may be used for rock-climbing, or for working at heights.

5 Claims, 6 Drawing Sheets

ENERGY ABSORBING DEVICE FOR USE WITH A SAFETY LANYARD AND SYSTEM INCLUDING THE DEVICE

BACKGROUND OF THE INVENTION

The invention relates to an energy absorbing device associated to a safety lanyard, and comprising a body equipped with means for passing the rope to generate a securing force due to the friction of the rope when the latter slides on the body.

The main function of such a device consists in limiting the force exerted on the rope when stopping a mass in movement, notably in case of a climber falling. Known devices are generally formed by a simple metal plate drilled with several circular holes for passage of the rope, so as to form an interleaving of several elementary turns. The diameter of each hole corresponds appreciably to that of the rope. Fitting of the rope on the body of the device is complicated, as the rope has to be passed at least five or six times through the holes to achieve a sufficient securing force.

SUMMARY OF THE INVENTION

The object of the invention is to achieve a reliable energy absorbing device, notably for an easily operational safety lanyard, regardless of the mode of use on a fixed rope or a hand rail.

The energy absorbing device according to the invention is characterized in that the means for passing the rope of cylindrical cross-section comprise a first orifice allowing two strands of rope to cross without clearance, and a second reverse V-shaped orifice of decreasing cross-section in the direction of the first orifice, said second orifice having a portion of reduced width of a smaller dimension than the diameter of the rope, and two convergent edges for centering the rope when the turn is tightened during said sliding.

According to one feature of the invention, the first orifice presents an appreciably ellipsoidal configuration, and the greatest distance of the first orifice corresponds appreciably to twice the diameter of the rope.

The mid-axis of symmetry of the body passes through the bottom of the second orifice and through the centre of the first orifice.

The jamming effect of the safety rope in the V of the second orifice, and the crossing of the strands of rope in the first orifice enable optimum braking to be obtained with a single self-jamming turn.

According to a preferred embodiment, the energy absorbing device is integrated in a safety lanyard having two strands of rope, and two attachment loops. Each attachment loop comprises stop means coming into engagement against the body at the end of sliding travel of the rope.

BRIEF DESCRIPTION OF THE DRAWINGS

Other advantages and features will become more clearly apparent from the following description of an embodiment of the invention, given as a nonrestrictive example only and represented in the accompanying drawings, in which.

DETAILED DESCRIPTION OF THE PREFERRED EMBODIMENT

Figure 1:
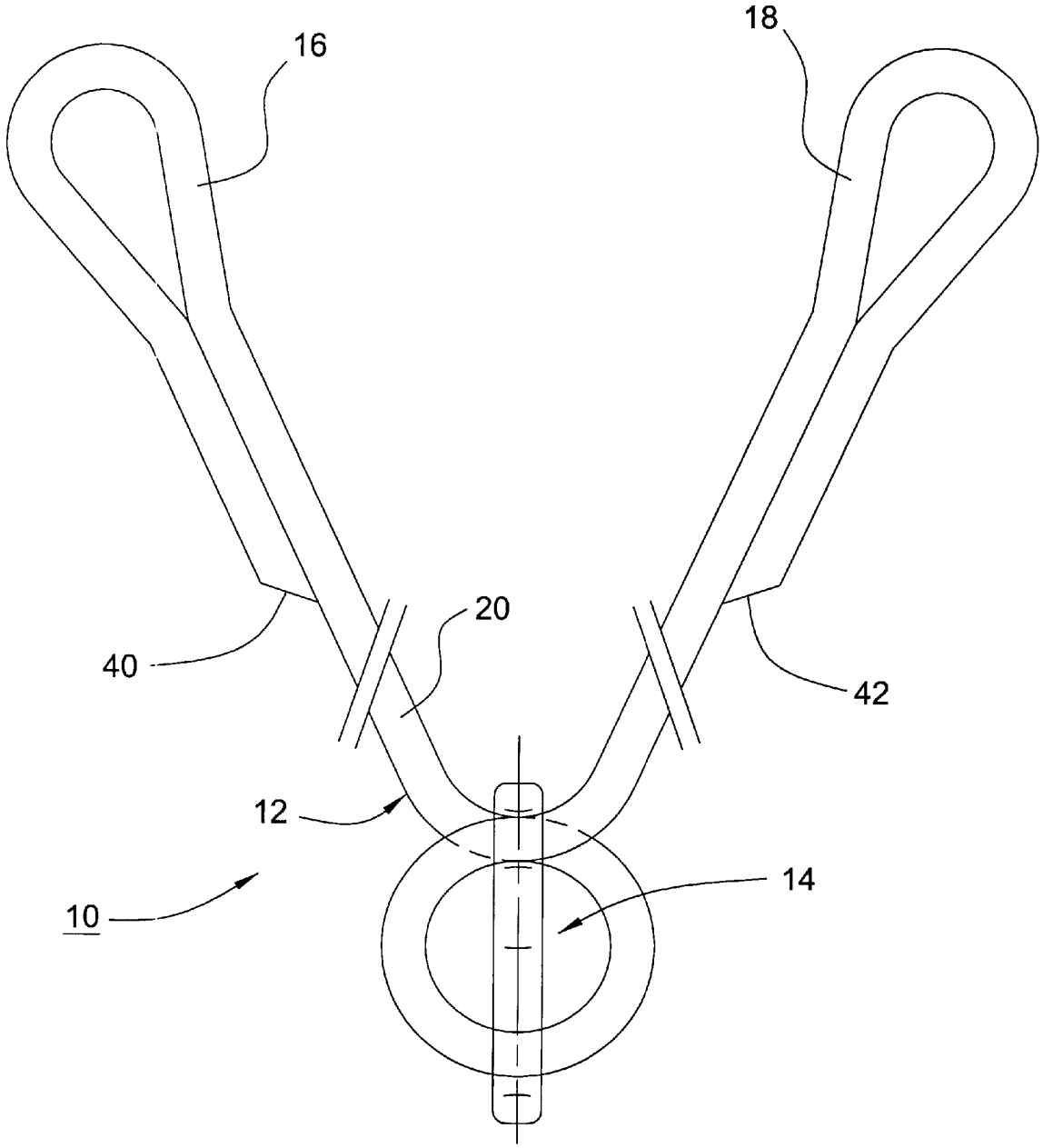
FIG. 1 is a schematic side view of a safety lanyard equipped with the energy absorbing device according to the invention.

In FIG. 1, a safety lanyard 10 for rock-climbing or pot-holing is formed by cooperation of a safety rope 12 of circular cross-section with an energy absorbing device designated by the general reference 14.

Each end of the safety rope 12 comprises an attachment loop 16, 18 arranged in the extension of an intermediate strand of rope 20, 22 joined to the energy absorbing device 14. Depending on the mode of use of the safety lanyard 10, the energy absorbing device 14 can be attached to the user's harness or to a fixed securing part. The attachment loops 16, 18 are secured alternatively to a securing plate or to a hand rail, formed for example by a cable secured to the rock.

Only one of the intermediate strands 20, 22 is active, whereas the other one remains inactive. When the attachment loop 16 is fixed to the securing plate or to the hand rail, the strand of rope 20 is active whereas the attachment loop 18 falls freely downwards due to the effect of gravity. Reciprocally, the strand of rope 22 is in the active state when the attachment loop 18 is fixed to the securing plate or to the hand rail and the other attachment loop 16 is free.

Figure 2:
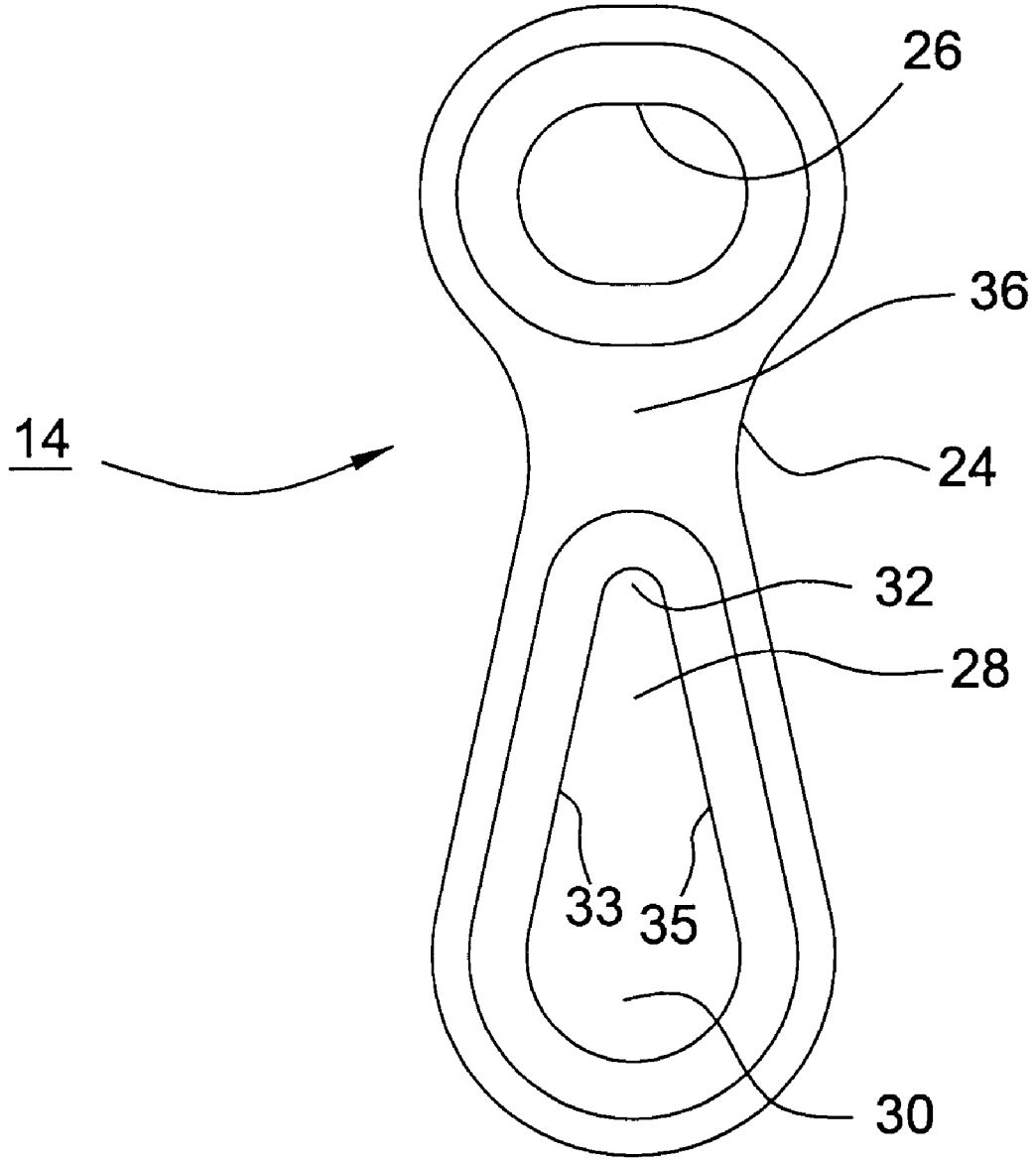
FIG. 2 shows an elevational view on an enlarged scale of the energy absorbing device of FIG. 1.
Figure 4:
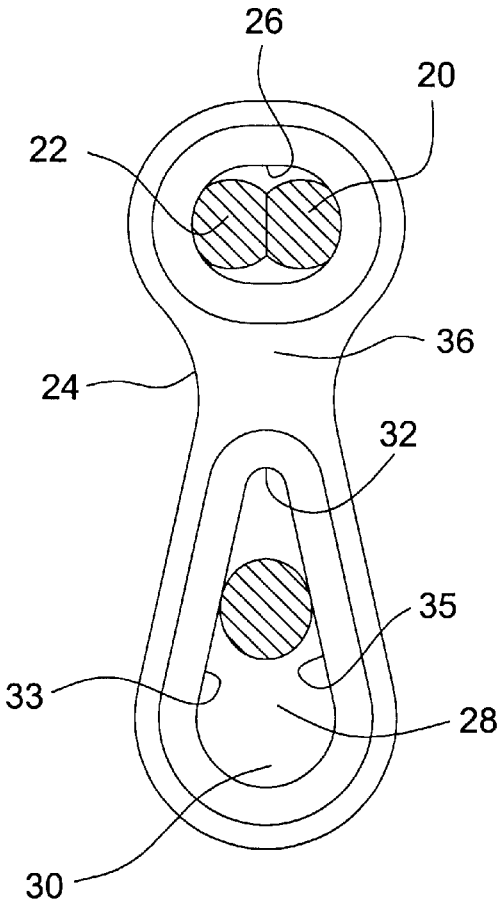
FIG. 4 is a cross-sectional view along the line 4—4 of FIG. 3.
Figure 3:
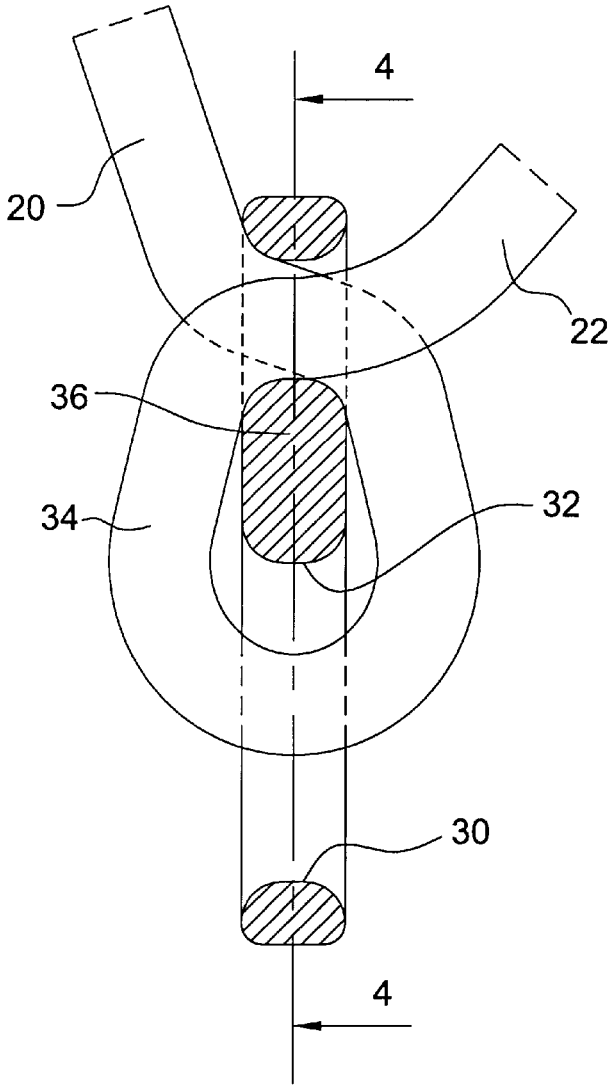
FIG. 3 represents a cross-sectional view of the energy absorbing device of FIG. 1, before any tension is applied to the safety rope.

With reference to FIGS. 2 to 4, the energy absorbing device 14 comprises a metallic body 24 equipped with two orifices 26, 28 for passage of the rope 12. The first orifice 26 presents an appreciably ellipsoidal shape, allowing crossing of the two strands of rope 20, 22. The shortest distance measured vertically between the two parallel sides of the ellipse, is slightly greater than the diameter of the rope 12.

The second orifice 28 comprises a reverse V-shaped configuration of decreasing cross-section in the direction of the first orifice 26. The dimension of the widened portion 30 of the orifice 28 is appreciably greater than the diameter of the rope 12, whereas the portion of reduced width 32 presents a wedge shape having a dimension half the size of the diameter of the safety rope 12.

The distance separating the convergent oblique edges 33, 35 at the level of the intermediate part of the second orifice 28 corresponds appreciably to the diameter of the safety rope 12 (see FIG. 4).

The rope 12 is in the shape of a closed turn 34 (FIG. 3) when it is fitted in place via the orifices 26, 28 of the energy absorbing device 14. The two orifices 26, 28 are separated from one another by a spacer 36 situated in the central part of the body 24.

Figure 6:
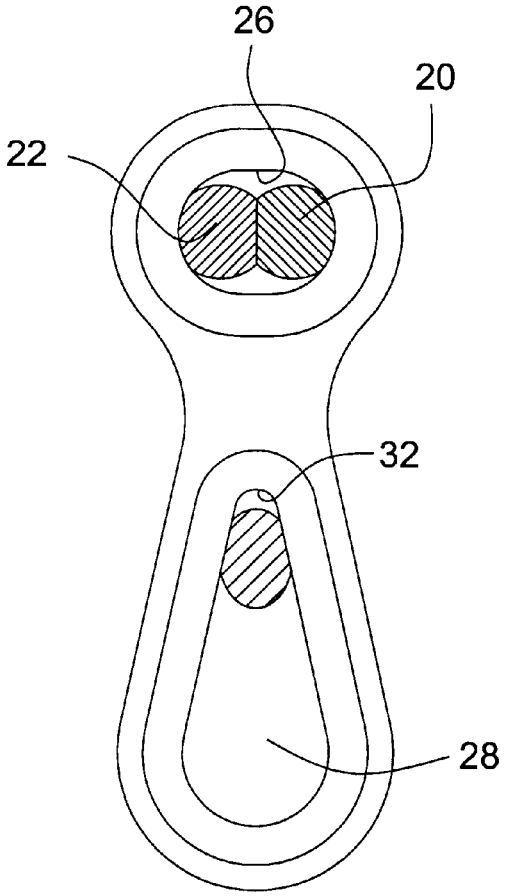
FIGS. 5 and 6 are identical views to FIGS. 3 and 4, after a tension has been applied to the safety rope.
Figure 5:
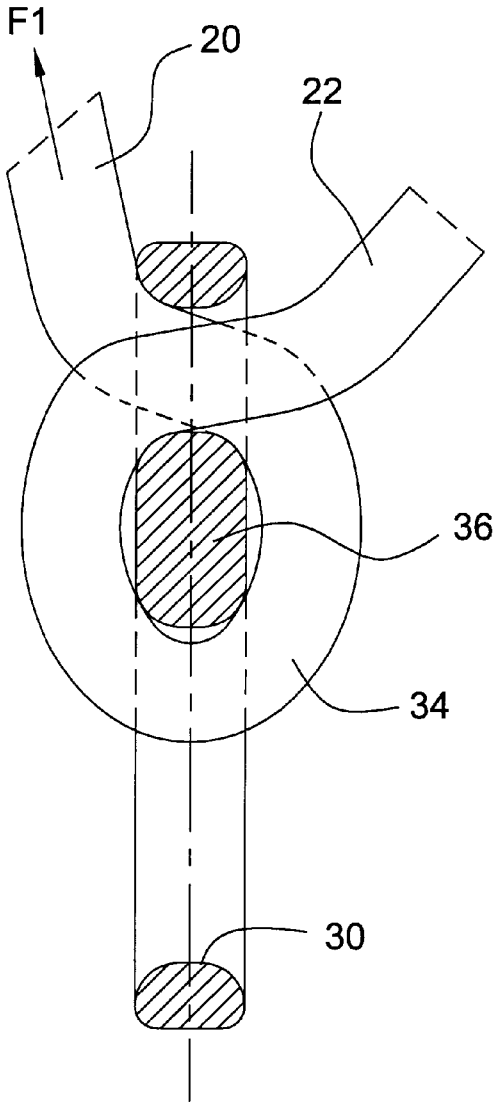

In FIGS. 5 and 6, a moderate application of tension (arrow F1) on the active rope strand 20 causes progressive tightening of the turn 34, and engagement of the rope in the part of reduced width 32 at the bottom of the V of the second orifice 28. In this position, jamming of the rope 12 in the energy absorbing device 14 generates a securing force due to the friction effect of the rope in the orifices 26, 28.

This results in a braking force which occurs up to a preset force threshold, so as to stop the fall or progression movement of the user without creating too great stresses for the whole of the safety chain formed by the rope, the securing plate and the harness.

Figure 7:
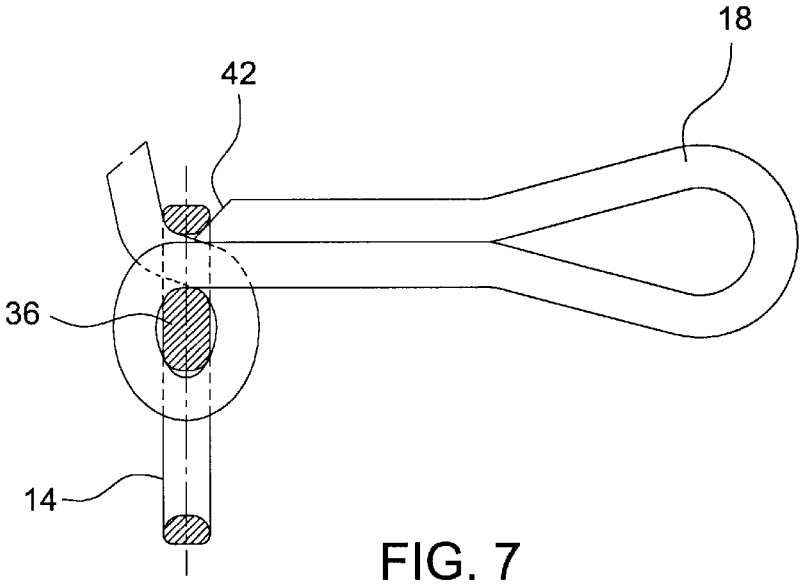
FIG. 7 is an identical view to FIG. 5, and shows the lanyard at the end of sliding after a fraction of the falling energy has been absorbed.

In the case of a sudden tension being applied to the active rope strand 20, for example when falling from a great height, the safety rope slides in the energy absorbing device 14, but still exerting a braking force to absorb a part of the energy of the fall. When the loop 18 of the non-active rope strand 22 comes into engagement at the end of travel against the body 24 at the level of the first orifice 26, and before the fall is finally stopped, the remaining energy is absorbed by the elasticity of the rope 12 (FIG. 7).

Figure 8:
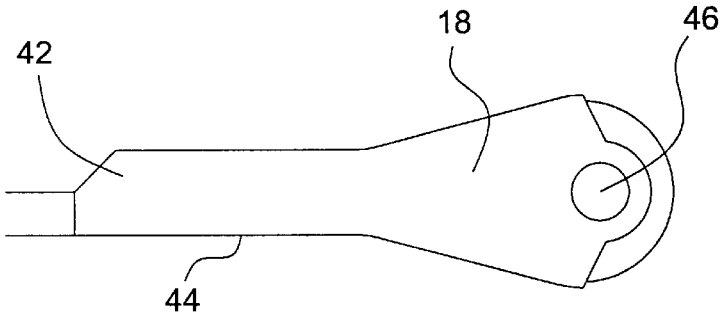
FIG. 8 shows the end of an attachment loop associated to a protective sleeve.
Figure 9:
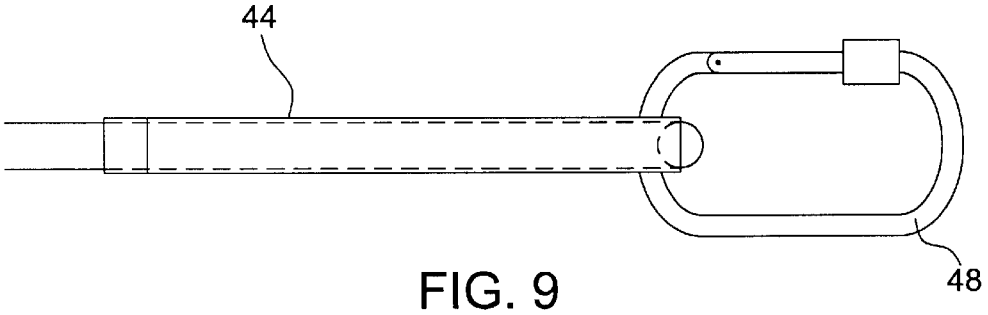
FIG. 9 is a plan view of FIG. 8, after a snap-hook has been fitted.

Each attachment loop 16, 18 is advantageously provided with stop means 40, 42 in the form of ramps enabling wear to be prevented in case of sewn loops. These ramps can be arranged directly at the end of each loop 16, 18 (FIGS. 1 and 7), or be disposed on a protective sleeve 44 (FIGS. 8 and 9), which is fitted to the attachment loop.

The sleeve 44 comprises a circular hole 46 opposite the ramp 42 to allow passage of a snap-hook 48 inside the attachment loop. The presence of the sleeve 44 protects each attachment loop 16, 18 and at the same time serves the purpose of securing the snap-hook without any clearance.

Figure 10:
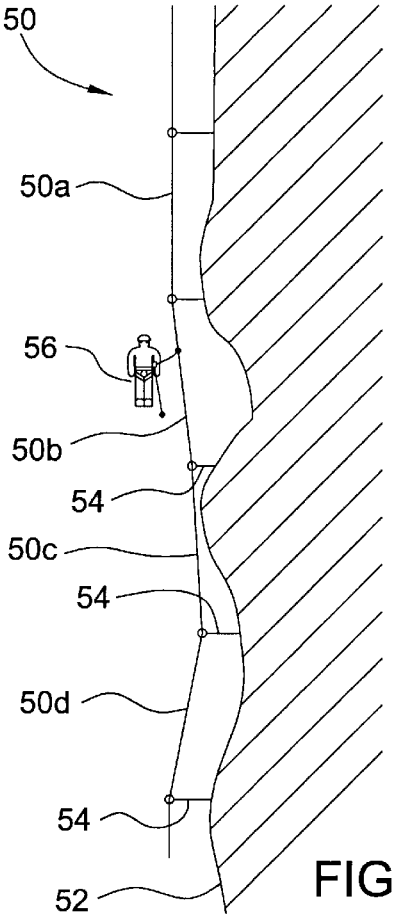
FIGS. 10 and 11 represent a first application of the safety lanyard to a hand rail, respectively before and during the climber's fall.
Figure 11:
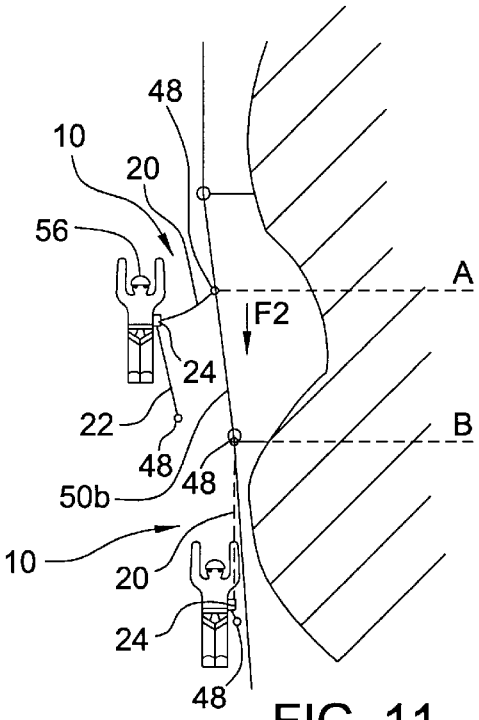

FIGS. 10 and 11 show a first use of the safety lanyard 10 on a hand rail 50, which is formed by several sections of cables 50*a*, 50*b*, 50*c*, 50*d*, fixed to the rock 52 by fixing brackets 54. The body 24 of the energy absorbing device 14 is attached to the harness of the climber 56, and the snap-hook 48 of the active strand 20 passes in the section of cable 50*b*. The other strand 22 of the safety rope 12 is inactive and hangs downwards due to gravity. Should the climber 56 fall, the snap-hook 48 moves down from level A in the direction of the arrow F2, and is stopped by the fixing bracket 54 at level B.

The strand of rope 20 is lengthened following sliding of the rope 12 in the orifices 26, 28 of the energy absorbing device 14 (FIG. 11 in broken line). The sliding effect comes to an end when the ramp 42 of the inactive strand 22 comes up against the stop formed by the body 24.

Figure 12:
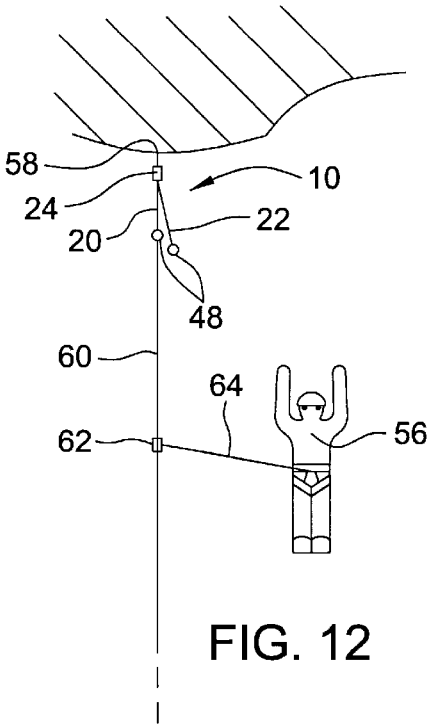
FIGS. 12 and 13 show a second application of the safety lanyard to a fixed rope, respectively before and after the climber's fall.
Figure 13:
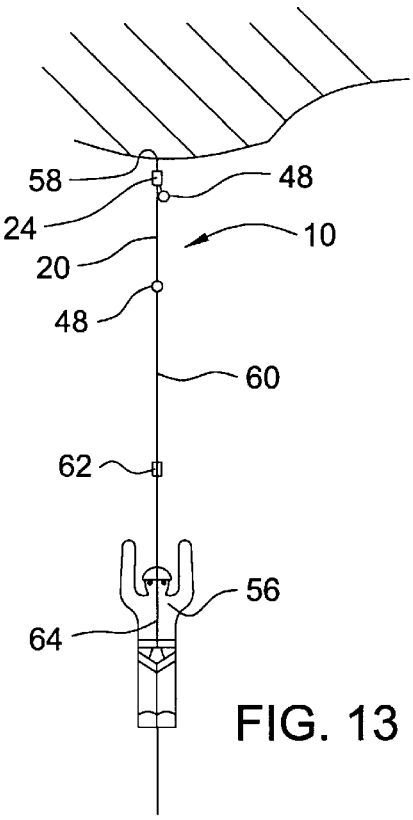

In FIGS. 12 and 13, the body 24 of the safety lanyard 10 is secured to an up-hill securing point 58, and the strand of rope 20 is attached to a rope 60. The safety of the climber 56 is ensured by means of a jammer 62 cooperating with the abseiling rope 60, and connected to the harness by a link cord 64. The other strand of rope 22 is free and inactive. Should the climber 56 fall (FIG. 13), a fraction of the energy is first absorbed by the safety lanyard 10, and then by the elasticity of the abseiling rope 60.

We claim:

1. An energy absorbing system, comprising:

a safety rope of cylindrical cross-section; and an energy absorbing device including:

a body equipped with means for passing said rope to generate a securing force due to the friction of said rope when said rope slides on said body, a first orifice arranged in said body through which two passes of said rope are inserted and cross without clearance within the first orifice, and a second reverse V-shaped orifice of decreasing cross-section in the direction of said first orifice through which said rope passes, said second orifice having a portion of reduced width of a smaller dimension than a diameter of said rope, and two convergent edges in said second orifice for centering said rope passing through said second orifice, when a turn of said rope is tightened during said sliding.

2. The energy absorbing system according to claim 1, wherein each end of the safety rope is provided with an attachment loop joined to the body by an intermediate rope strand, wherein each attachment loop comprises stop means coming into engagement against the body at the end of sliding travel of the rope.

3. The energy absorbing system according to claim 2, wherein the stop means are shaped as ramps cooperating with the body at the level of the first orifice.

4. The energy absorbing system according to claim 3, wherein the ramps are situated on a protective sleeve made of plastic material fitted onto each attachment loop.

5. The energy absorbing system according to claim 4, wherein the protective sleeve is provided with a hole for attaching a snap-hook through the attachment loop.

* * * * *